US007954662B2

(12) United States Patent
Ogura et al.

(10) Patent No.: US 7,954,662 B2
(45) Date of Patent: Jun. 7, 2011

(54) LIQUID STORAGE CONTAINER

(75) Inventors: Hideki Ogura, Yokohama (JP); Ryoichi Matsumoto, Tokyo (JP); Tetsuya Ohashi, Matsudo (JP); Shogo Kawamura, Numazu (JP); Ryoji Inoue, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 694 days.

(21) Appl. No.: 11/613,051

(22) Filed: Dec. 19, 2006

(65) Prior Publication Data

US 2007/0145059 A1 Jun. 28, 2007

(30) Foreign Application Priority Data

Dec. 28, 2005 (JP) ..... 2005-380064

(51) Int. Cl.

| | |
|---|---|
| ***B65D 1/32*** | (2006.01) |
| ***B65D 8/18*** | (2006.01) |
| ***B65D 65/00*** | (2006.01) |
| ***A47G 19/22*** | (2006.01) |

(52) U.S. Cl. ..... 220/723; 220/4.12; 220/721; 220/720; 220/529

(58) Field of Classification Search ..... 220/4.16, 220/4.12, 4.28, 4.01, 920, 919, 918, 721, 220/720, 529, 723; 347/86, 85, 87
See application file for complete search history.

(56) References Cited

U.S. PATENT DOCUMENTS

| | | | | |
|---|---|---|---|---|
| 5,440,333 | A * | 8/1995 | Sykora et al. | 347/87 |
| 5,732,751 | A * | 3/1998 | Schmidt et al. | 141/48 |
| 5,754,207 | A * | 5/1998 | Gragg et al. | 347/86 |
| 5,903,292 | A * | 5/1999 | Scheffelin et al. | 347/86 |
| 6,250,751 | B1 * | 6/2001 | Whitney et al. | 347/87 |
| 6,286,948 | B1 * | 9/2001 | Wu et al. | 347/86 |
| 6,494,568 | B2 * | 12/2002 | Hou et al. | 347/86 |
| 6,722,762 | B2 * | 4/2004 | Miyazawa et al. | 347/86 |
| 6,758,558 | B2 * | 7/2004 | Chiu et al. | 347/86 |
| 6,773,099 | B2 * | 8/2004 | Inoue et al. | 347/86 |
| 6,786,583 | B2 * | 9/2004 | Ota et al. | 347/86 |
| 6,905,199 | B2 * | 6/2005 | Miyazawa et al. | 347/86 |
| 6,926,396 | B2 * | 8/2005 | Ota et al. | 347/86 |
| 6,938,997 | B2 * | 9/2005 | Toba et al. | 347/86 |
| 6,945,641 | B2 * | 9/2005 | Sakai et al. | 347/86 |
| 6,979,079 | B2 * | 12/2005 | Hashii et al. | 347/86 |
| 7,008,053 | B2 * | 3/2006 | Hashii et al. | 347/86 |
| 7,029,104 | B2 * | 4/2006 | Sakai et al. | 347/86 |
| 7,104,640 | B2 * | 9/2006 | Ogura et al. | 347/86 |
| 7,165,835 | B2 * | 1/2007 | Ota et al. | 347/86 |
| 7,213,913 | B2 * | 5/2007 | Sakai et al. | 347/86 |
| 7,222,949 | B2 * | 5/2007 | Ichihashi et al. | 347/86 |
| 7,237,883 | B2 * | 7/2007 | Hashii et al. | 347/86 |

(Continued)

FOREIGN PATENT DOCUMENTS

| | | |
|---|---|---|
| JP | 06-183023 | 7/1994 |

*Primary Examiner* — Anthony Stashick
*Assistant Examiner* — Kareen Rush
(74) *Attorney, Agent, or Firm* — Canon USA Inc IP Divison

(57) ABSTRACT

A liquid storage container capable of ensuring a sufficient ink storage space and preventing liquid leakage without large variations in liquid pressure even when the container is deformed by an external force during shipping or in operating time. The container includes a protection member positioned outside of a flexible member, and an opening is defined on a plane member arranged in contact with the flexible member so as to face the protection member.

5 Claims, 11 Drawing Sheets

U.S. PATENT DOCUMENTS

| | | | | |
|---|---|---|---|---|
| 7,244,018 | B2 * | 7/2007 | Hashii et al. | 347/86 |
| 7,249,832 | B2 * | 7/2007 | Sakai et al. | 347/86 |
| 7,249,839 | B2 * | 7/2007 | King et al. | 347/108 |
| 7,255,432 | B2 * | 8/2007 | Lui | 347/86 |
| 7,258,431 | B2 * | 8/2007 | Shinada et al. | 347/86 |
| 7,278,721 | B2 * | 10/2007 | Shimizu et al. | 347/86 |
| 7,341,336 | B2 * | 3/2008 | King et al. | 347/86 |
| 7,367,652 | B2 * | 5/2008 | Miyazawa et al. | 347/49 |
| 7,377,628 | B2 * | 5/2008 | Oikawa et al. | 347/86 |
| 7,422,316 | B2 * | 9/2008 | Shinada | 347/86 |
| 7,422,317 | B2 * | 9/2008 | Miyazawa | 347/86 |
| 7,434,923 | B2 * | 10/2008 | Miyazawa et al. | 347/86 |
| 7,470,012 | B2 * | 12/2008 | Kojima et al. | 347/86 |
| 7,530,678 | B2 * | 5/2009 | Ogura et al. | 347/86 |
| 2003/0035036 | A1 * | 2/2003 | Ogura et al. | 347/86 |
| 2003/0067520 | A1 * | 4/2003 | Inoue et al. | 347/86 |

* cited by examiner

LIQUID STORAGE CONTAINER

BACKGROUND OF THE INVENTION

1. Field of the Invention

The present invention relates to a liquid storage container containing various kinds of liquid such as ink therein.

2. Description of the Related Art

In a recording apparatus for recording images on a recording medium using a recording head by applying liquid, such as ink, on the recording medium, a liquid storage container is provided for containing ink for supplying the ink to the recording head. In order to stably supply the liquid and prevent the liquid leakage, a predetermined negative pressure is generally applied to the liquid contained in such a liquid storage container.

Among configurations of such liquid storage containers, one has been in the form of the container in which a liquid absorbing body is provided for imparting the negative pressure using the power of the absorbing body for holding liquid. Other containers generating the negative pressure without using such an absorbing body include one using a spring as a negative pressure generating mechanism. This closed container has a casing (fixed member) forming part of the container with a flexible member attached thereto, which is deformable in a compression direction along with the outside delivery of ink from the container. Then, the negative pressure is generated in the container by urging the flexible member with a spring in a direction expanding the inner part of the container. Such a spring includes a semi-elliptic leaf spring disclosed in U.S. Pat. No. 5,754,207 and a coil spring in U.S. Pat. No. 6,250,751. As disclosed in Japanese Patent Laid-Open No. H06-183023, there is also a spring contained in a bag-like flexible member as a negative pressure generating mechanism.

In the liquid storage container that generates the negative pressure by the urging of the flexible member with a spring member so as to expand the interior part of the container in such a manner, a protection member, such as a lid member, is provided for protecting the flexible member against external pressure and impact. Such a protection member protects the liquid storage container from the impact and the static load applied by the dropping of the container during handling and shipping. When the deformation of components of the liquid storage container due to the external pressure is transmitted to the flexible member, rapid changes in pressure and the negative pressure cancellation are occurred in the container, leading to the ink leakage. The protection member prevents such ink leakage.

In a liquid storage container made of resins, the deformation of the resin protection member due to the external pressure is difficult to be avoided. When an external pressure is applied to a rectangular parallelepiped liquid storage container, the maximum superficial area part is deformed to the utmost. Hence, the maximum deformation of the flexible member is designed so that the flexible member does not touch the lid member when the flexible member deforms to the utmost in a direction expanding the interior part of the container. The limitation of the maximum deformation of the flexible member substantially reduces the ink storage amount.

In order to prevent the deformation of the protection member, the thickness of the resin forming the member may be increased, or the protection member may be made of a material with a higher rigidity than that of the resin such as a metal.

However, when the thickness of the maximum superficial area part of the container is increased, the ink storage amount is reduced. Use of the high rigid material, such as a metal, also increases product cost.

FIGS. 12A to 13C show configurations of liquid storage containers in which the shape of the flexible member is specified in view of the deformation of the protection member for suppressing the reduction in storage amount. A casing member 1 and a flexible member 4 adhered on the internal periphery of the casing member 1 form a storage space for a liquid 7 such as ink. On the internal surface of the flexible member 4, a plane member 3 is located, and on the opening of the casing member 1, a lid member 5 is attached for protecting the flexible member 4 as a protection member. A spring member 2 provided within the storage space for the liquid 7 urges the flexible member 4 with the plane member 3 therebetween upwardly in FIGS. 13A to 13C, i.e., in a direction expanding the storage space. Thereby, a negative pressure is applied to the liquid 7. FIG. 13B shows the state when the lid member 5 is deformed to the utmost due to an external force. As shown in FIG. 12A, the plane member 3 is provided with a recess 11 formed thereon with approximately the same shape as that of the lid member 5 deformed to the utmost. The relationship between the recess and the liquid storage amount is shown in FIGS. 13A to 13C. The flexible member 4 is always controlled to have substantially the same shape as that of the lid member 5 deformed to the utmost, so that the portion of the flexible member 4 corresponding to that of the plane member 3 is concave.

The plane member 3 is made of a metallic plate or a comparatively thick resin plate (at least 1 to 2 mm in thickness), which are not deformed by low pressure, for transmitting a force generated by the spring member 2. Hence, the downward protruding portion of the recess 11 of the plane member 3, which is formed in approximately the same shape as that of the lid member 5 deformed to the utmost, comes in contact with the internal bottom surface of the casing member 1 when the liquid 7 is used up, as shown in FIG. 13C. As a result, the deformation of the plane member 3 toward the casing member 1 is inhibited. If the flexible member 4 is further deformed from the state of FIG. 13C, the distance between the flexible member 4 and the casing member 1 is further reduced, so that the negative pressure in the liquid storage space is rapidly increased. When the liquid is ink, the ink cannot be supplied to a recording head from an ink supply port 6 at that time. Furthermore, when part of the flexible member 4 comes in contact with the casing member 1, the ink flow to the ink supply port 6 is blocked off in this state, leading to residual ink in the storage space.

SUMMARY OF THE INVENTION

The present invention is directed to a liquid storage container capable of ensuring a sufficient ink storage space without large variations in liquid pressure even when the container is deformed by an external force during shipping or in operating time.

The present invention is also directed to a liquid storage container capable of appropriately ejecting liquid by preventing liquid leakage while a stable pressure being maintained.

A liquid storage container according to one aspect of the present invention includes a flexible member and a wall forming a liquid storage space; a supply port facilitating supplying liquid in the liquid storage space to the outside; a protection member positioned outside of the flexible member; a plane member arranged in contact with the flexible member and having an opening defined at a position facing the protection member; and a spring member for urging the flexible member with the plane member disposed therebetween so as to generate a negative pressure in the liquid storage space, and the opening is defined at the center position of gravity on the plane member.

Further features of the present invention will become apparent from the following description of exemplary embodiments with reference to the attached drawings.

DESCRIPTION OF THE EMBODIMENTS

Embodiments of the present invention will be described below with reference to the drawings.

First Embodiment

Figure 1A:
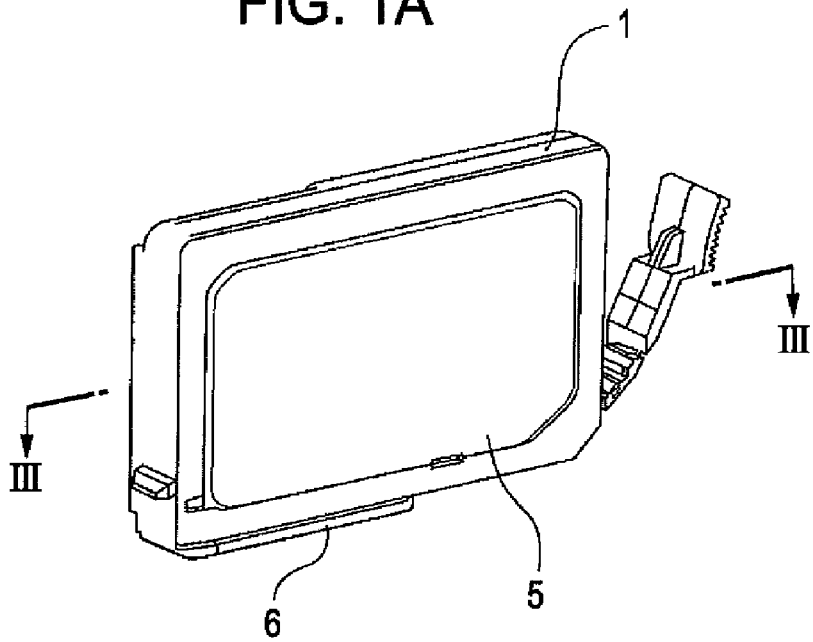
FIG. 1A is a perspective view of a liquid storage container according to a first embodiment of the present invention.
Figure 1B:
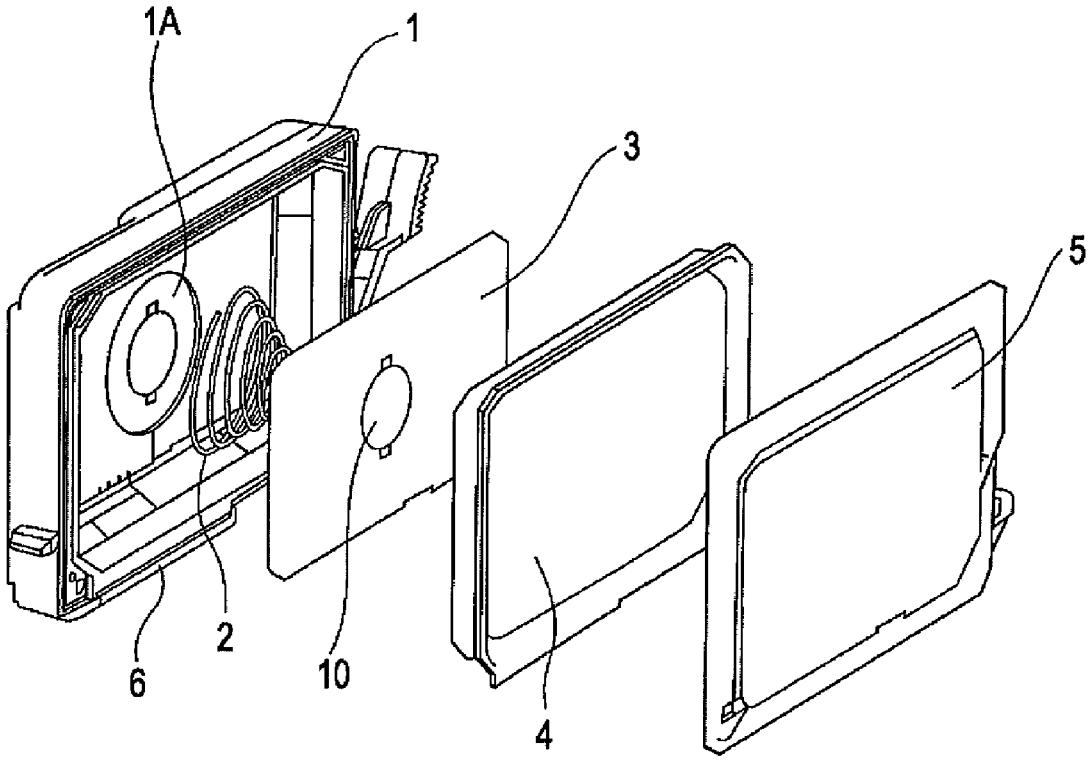
FIG. 1B is an exploded perspective view of the liquid storage container.

FIGS. 1A to 6B are exemplary drawings for illustrating a first embodiment of the present invention. FIG. 1A is a perspective view of a liquid storage container according to the embodiment; FIG. 1B is an exploded perspective view of the liquid storage container. A casing member 1 and a flexible member 4 adhered on the internal periphery of the casing member 1 form a storage space for a liquid 7 such as ink as shown in FIG. 3A. The flexible member 4 using a soft sheet is bonded to the casing member 1 by welding so as to ensure the closure of the storage space of the liquid. A plane member 3 is positioned on the internal surface facing ink of the flexible member 4 while a lid member 5 is attached on the opening of the casing member 1 for protecting the flexible member 4 as a protection member.

Figure 13A:
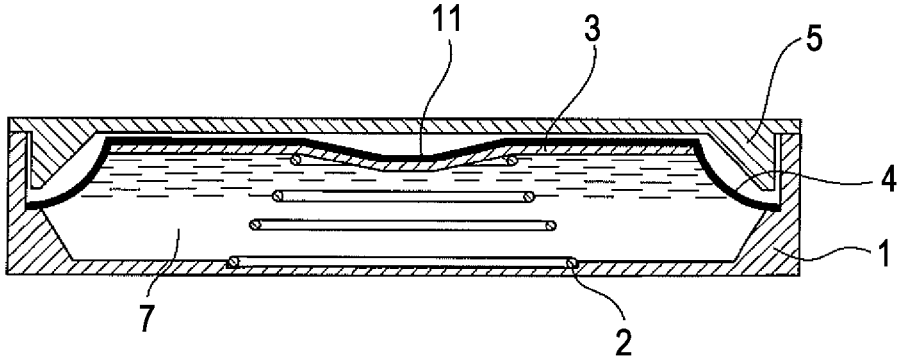
FIG. 13A PRIOR ART
FIG. 13A is a sectional view at the line XIII-XIII of the liquid storage container shown FIG. 12A when the container is sufficiently filled with liquid.
Figure 13B:
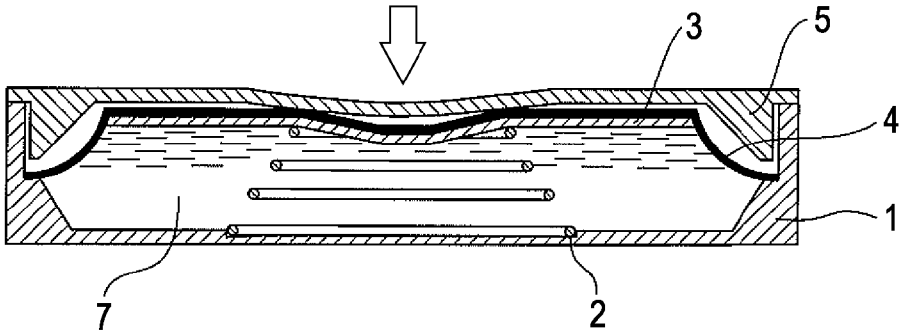
FIG. 13B PRIOR ART
FIG. 13B is the sectional view when the container is deformed.
Figure 13C:
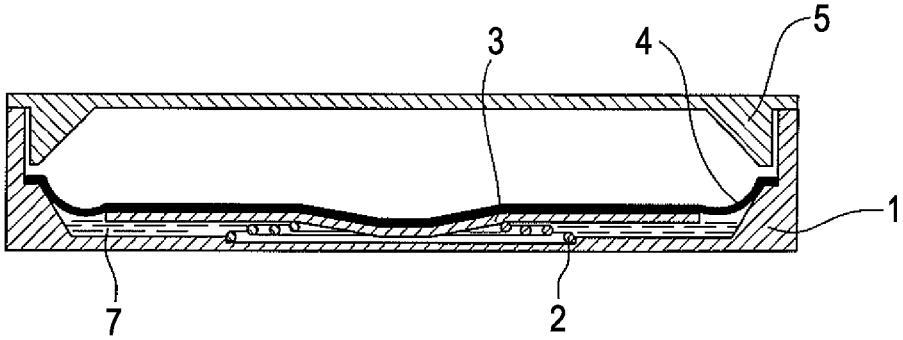
FIG. 13C PRIOR ART
FIG. 13C is the sectional view after the liquid is supplied outside.

The plane member 3 is provided with an opening 10 formed at its center of gravity, and a spring member 2 is brought into contact with the opening 10 of the plane member 3. The spring member 2 provided within the storage space for the liquid 7 urges the flexible member 4 with the plane member 3 therebetween upwardly in FIG. 13A, i.e., in a direction expanding the storage space. The plane member 3 serves to transmit the urging force of the spring member 2 to the flexible member 4 so as to maintain the negative pressure in the liquid storage container within a predetermined range for stabilizing the liquid ejection. In such a manner, the spring member 2 functions as a negative pressure generating mechanism for applying the negative pressure to the liquid 7. According to the embodiment, the pressure in the liquid storage container is adjusted with the spring member 2. The internal pressure in the liquid storage container is regulated so as not to exceed a predetermined pressure for preventing the liquid ejection from being affected until the bag-like storage space formed by the flexible member 4 is collapsed. The suitable pressure range for liquid ejection is a range of the liquid pressure in the liquid storage container under which the liquid ejected from a recoding head can make fine prints on a recording medium. This is also a range capable of finely continuing the liquid supply to an ejection nozzle. The casing member 1 is provided with a step portion 1A formed on the bottom surface for positioning the spring member 2. Thereby, the spring member 2 can maintain the stable urging force against the change in pressure in the liquid storage container.

The casing member 1 includes a liquid supply port 6 for delivering the liquid 7. In order to prevent the liquid leakage, the liquid supply port 6 is sealed with a rubber member having a slit, an absorbing member for generating a meniscus force resistible to the negative pressure in the liquid storage container, and a capillary force generating member such as a filter. The present invention can be applied to the liquid storage container having any configuration of the liquid supply port 6. The liquid 7 is delivered from the liquid supply port 6 while being applied by the negative pressure, so that the flexible member 4 is deformed in accordance with the residual amount of the liquid 7 in the liquid storage container. When ink as the liquid 7 is stored for supplying it to a recording head, the ink under a predetermined negative pressure imparted thereto is supplied to the recording head from the liquid supply port 6. The recording head can be detachably connected to the liquid supply port 6 directly or indirectly.

Figure 2A:
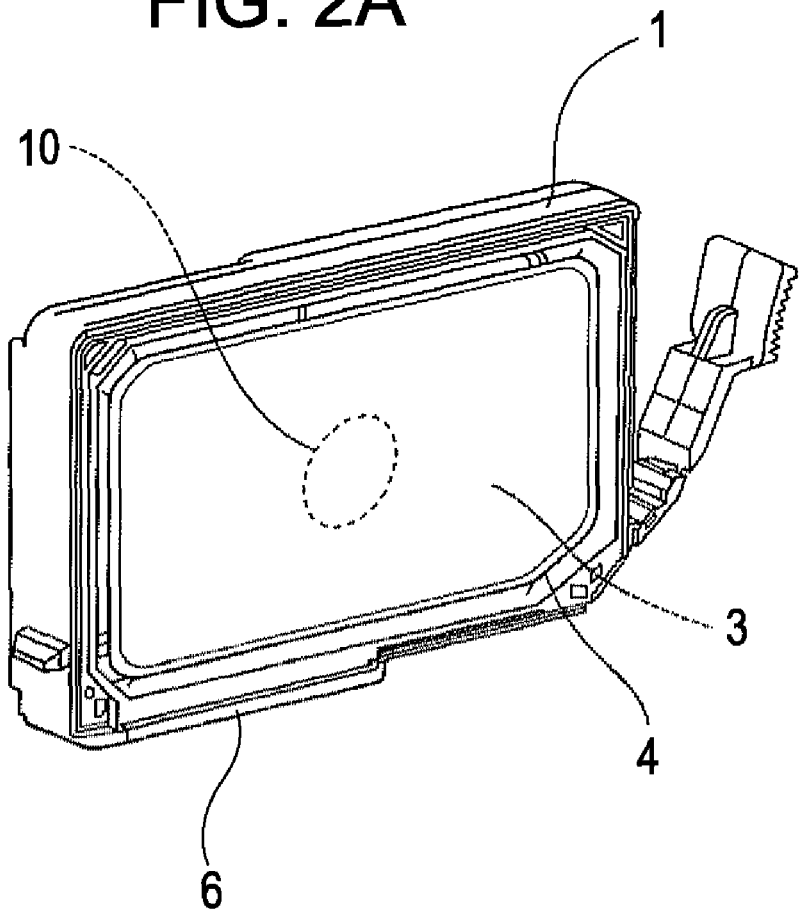
FIG. 2A shows the container of FIG. 1A from which a lid member is removed.
Figure 2B:
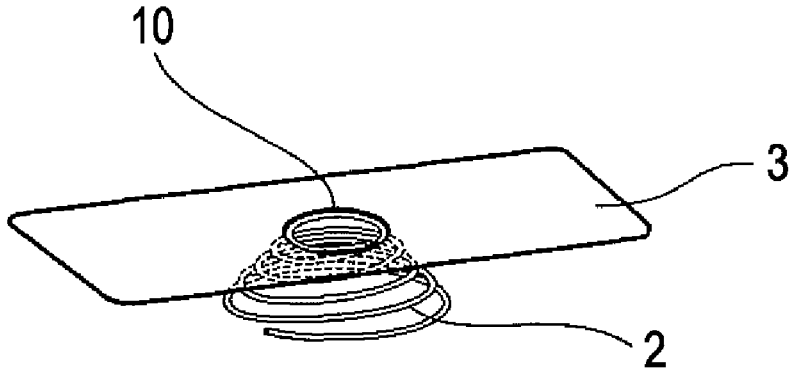
FIG. 2B shows the coupling state between a spring member and a plane member.

FIG. 2A is a perspective view of the liquid storage container from which the lid member 5 is removed; FIG. 2B is a perspective view of the plane member 3 and the spring member 2. One end of the spring member 2 is connected to the internal surface of the plane member 3 by welding. The plane member 3 according to the embodiment is a rectangular plate in plan view and has a circular opening 10 formed at its center of gravity. The opening 10 is positioned to face the side panel, which is deformable to the utmost by the external pressure, of the liquid storage container, i.e., the center of the lid member 5. The spring member 2 according to the embodiment is a circular conic coil spring and its smaller diameter side is connected to the opening 10 of the plane member 3. The spring member 2 maintains the internal pressure of the liquid storage container by exerting a load in operating time of the container, and it may be made of any type such as a compression coil spring, a circular conic coil spring, and a leaf spring.

Figure 3A:
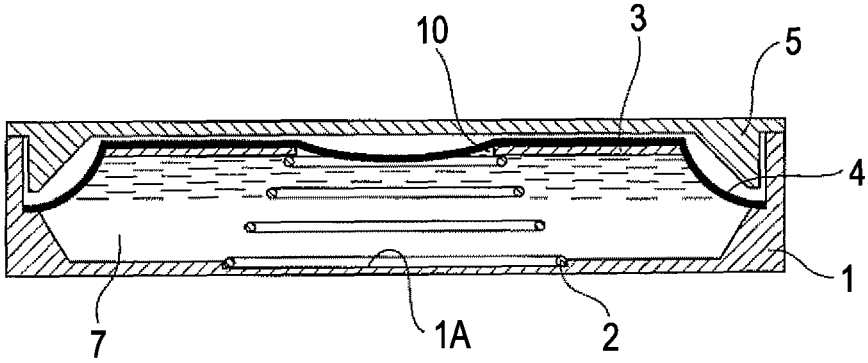
FIG. 3A is a sectional view at the line III-III of FIG. 1A when the container is sufficiently filled with liquid.
Figure 3B:
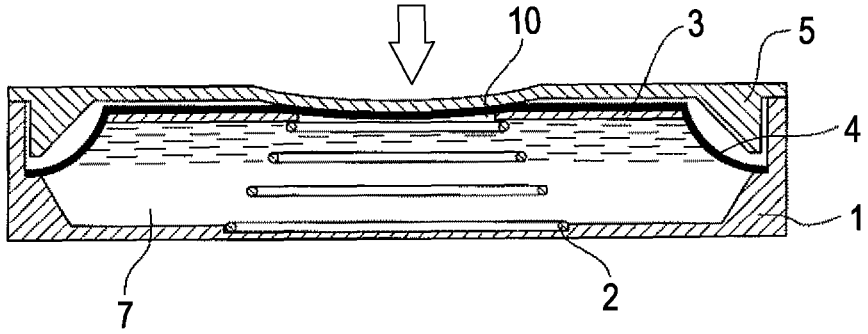
FIG. 3B is the sectional view when the container is deformed.
Figure 3C:
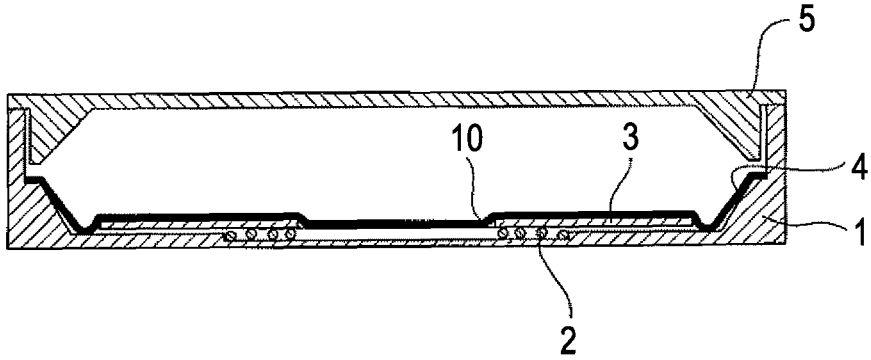
FIG. 3C is the sectional view after the liquid is supplied outside.

FIG. 3B is an explanatory view of the container when the deformation is generated in the center of the lid member 5 due to the external pressure. The central portion of the lid member 5 forming the maximum side panel of the container is deformable to the utmost by the external pressure. When the central portion of the lid member 5 is deformed, the contact between the plane member 3 and the lid member 5 deformed by the external force can be avoided because of the opening 10 formed on the plane member 3. Hence, the external force is not transmitted to the storage space of the liquid 7, thereby avoiding pressure changes within the liquid storage container. Since the shape of the plane member 3 is not largely changed as a pressure plate, as shown in FIG. 3C, the liquid 7 can be used up without the residual liquid 7 in the container.

Figure 4A:
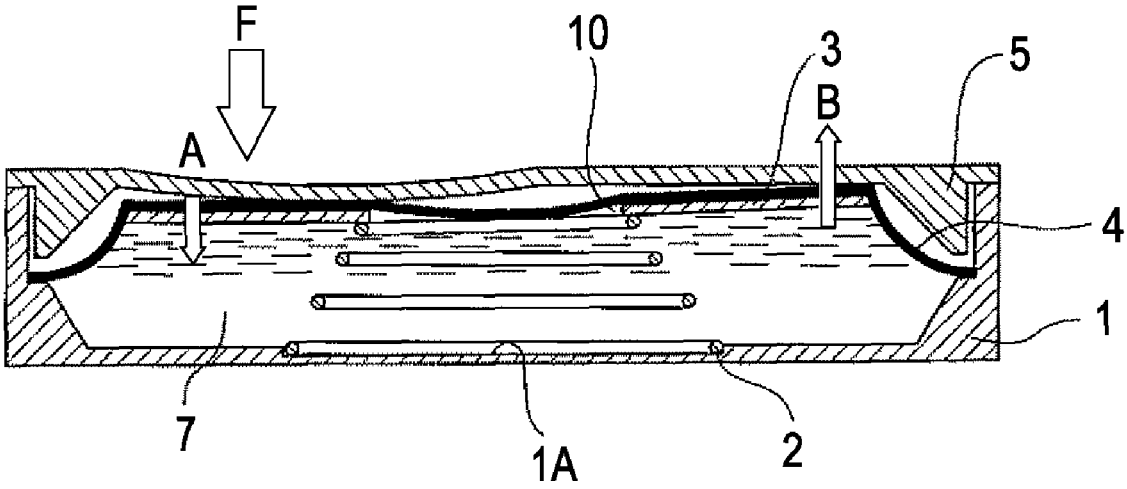
FIG. 4A is another sectional view when the container is deformed.

According to the embodiment, the opening 10 is located at the center of gravity of the plane member 3 and has a diameter similar to the smaller diameter of the circular conic coil spring. Since the plane member 3 is in contact with the smaller diameter side of the circular conic coil spring, as shown in FIG. 4A, even when the deformation of the lid member 5 due to an external pressure F is transmitted to an end portion of the plane member 3 in arrow A direction, the internal pressure of the liquid in the container is not largely changed. That is, when the deformation due to the external pressure is transmitted to the plane member 3 as shown in FIG. 4A, the plane member 3 is displaced by a comparatively small force against the internal pressure. The flexible member 4 also follows this displacement, so that the internal pressure is not largely changed, maintaining a predetermined negative pressure. The deformation of the central portion of the lid member 5 is accommodated in the opening 10 of the plane member 3, so that the leakage of the liquid 7 due to the pressure change does not occur.

Furthermore, since the opening is located in the center of gravity of the plane member, the external pressure F is distributed around the spring member 2 to A and B in the liquid storage container. Since the spring member absorbs the large pressure change in the container so as to distribute it in a well-balanced manner, the pressure change in the container can be alleviated.

Figure 4B:
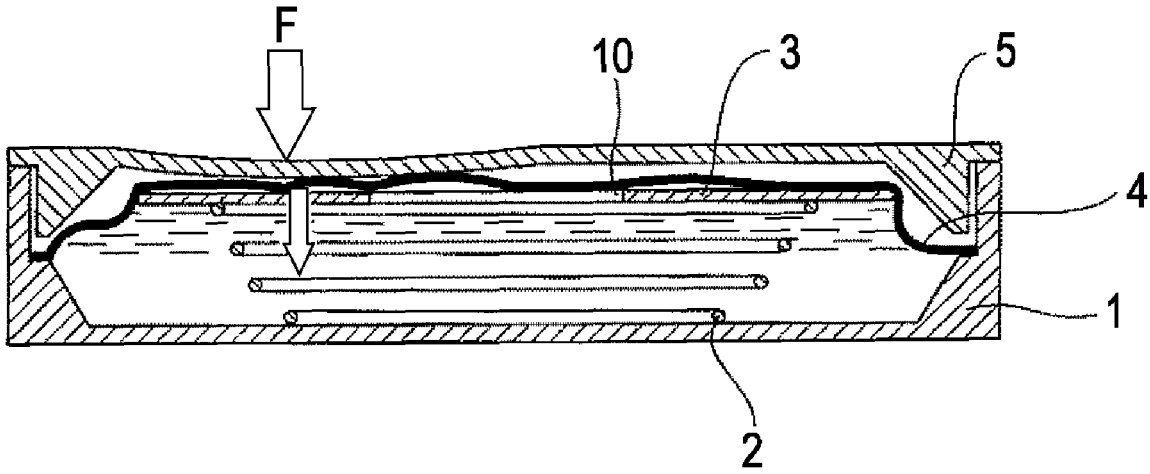
FIG. 4B is a sectional view when the larger diameter side of the spring touches the plane member.

FIG. 4B is an explanatory view of a comparative example in that the larger diameter side of the circular conic coil spring as the spring member 2 is in contact with the plane member 3 in reverse to the embodiment. The opening 10 is located at the center of gravity of the plane member 3. In the comparative example, the larger diameter side of the circular conic coil spring is in contact with a wide range of the plane member 3. When the external force F is applied at a position slightly displaced from the center of the container, the plane member 3 is pushed downwardly across the board. As shown in FIG. 4A, when the smaller diameter side of the circular conic coil spring is in contact with the plane member 3 according to the embodiment, the external force F is applied to the position A outside the coil diameter. As shown in FIG. 4B, when the larger diameter side of the circular conic coil spring is in contact with the plane member 3 according to the comparative example, the external force F is applied to the position inside the coil diameter. At this time, since the load is applied on the total surface held by the inside of the coil diameter, the larger load is consequently applied on the total plane member 3 in comparison to the embodiment of FIG. 4A.

Hence, as shown in FIG. 4A, the contact between the smaller diameter side of the circular conic coil spring and the plane member 3 reduces the load applied to the total circular conic coil spring so as to be advantageous in suppressing the pressure change.

Figure 5A:
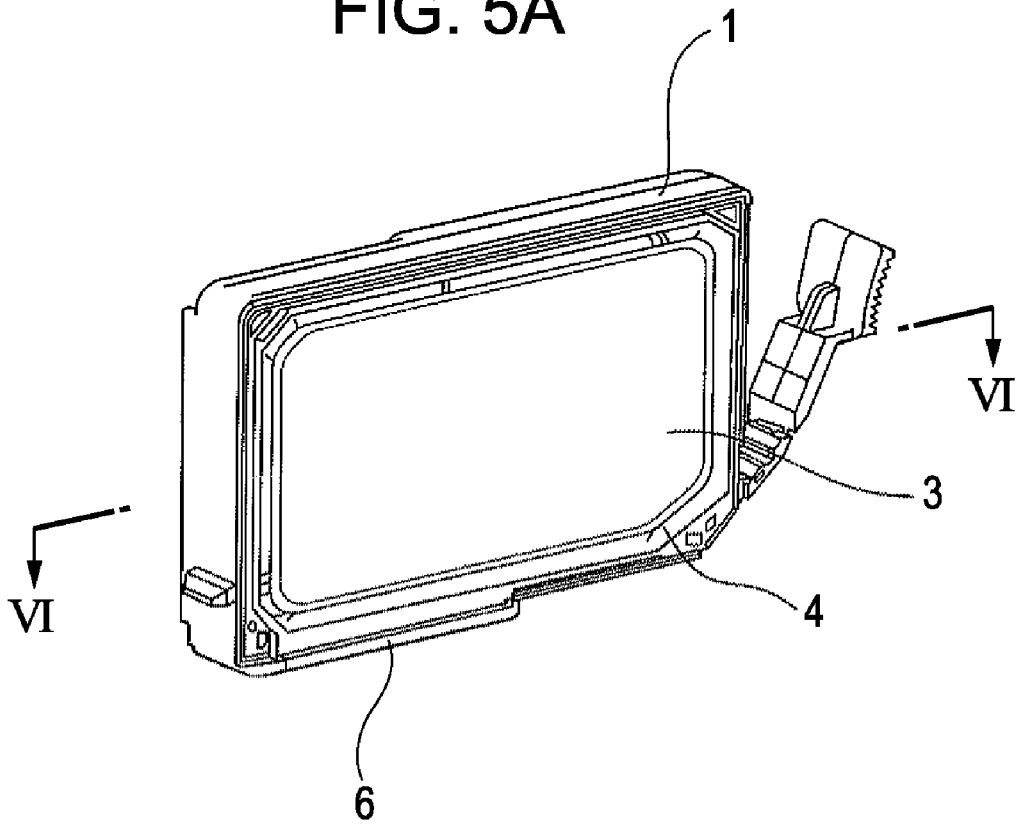
FIG. 5A is a perspective view of a liquid storage container with a plane member without an opening.
Figure 5B:
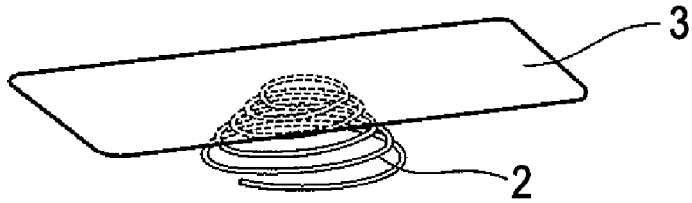
FIG. 5B is a perspective view of the coupling state between the spring member and the plane member without the opening.

FIGS. 5A to 6B are explanatory views of the liquid storage container having the plane member 3 without the opening 10; FIG. 5A is a perspective view of the liquid storage container from which the lid member 5 is removed; and FIG. 5B is a perspective view of the state of connection between the plane member 3 and the spring member 2.

Figure 6A:
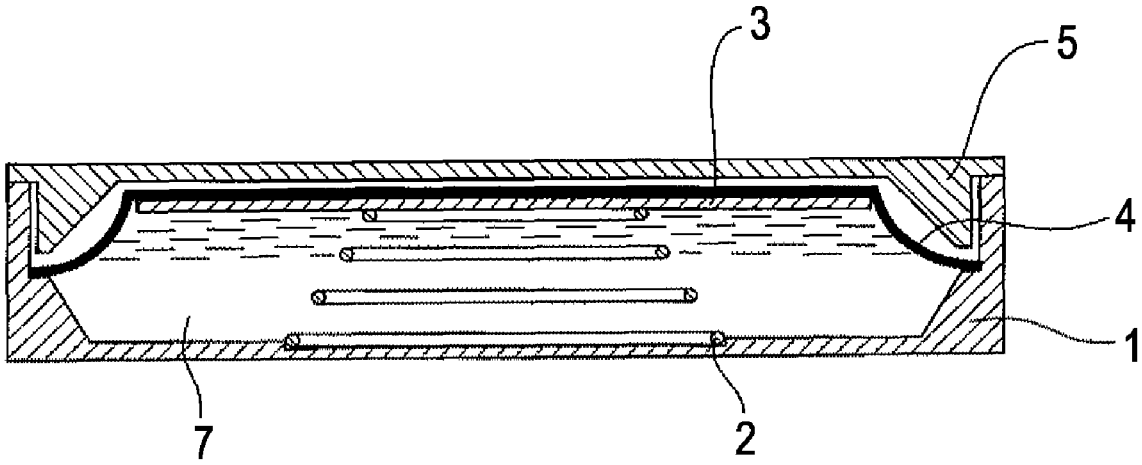
FIG. 6A is a sectional view of the liquid storage container at the line VI-VI of FIG. 5A.

In the liquid storage container using the flexible member 4, the negative pressure is generated so that the liquid 7 does not leak in its initial use. In such a liquid storage container, as shown in FIG. 6A, the plane member 3 and the flexible member 4 are drawn toward the storage space due to the initial internal negative pressure, so that the flexible member 4 is held in a drawn state into the storage space. In order to generate the initial internal negative pressure, the storage amount of the liquid 7 needs to be less than the capacity of the storage space by several milliliters. In order to ensure the large capacity of the liquid 7, the displacement of the plane member 3 toward the inside of the storage space due to the initial internal negative pressure must be minimized.

Figure 6B:
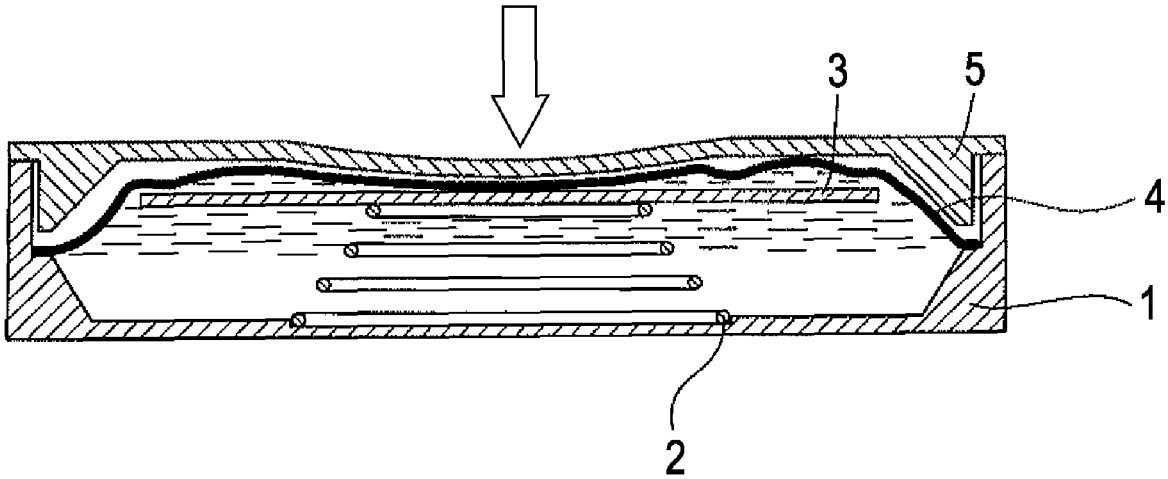
FIG. 6B is a sectional view at the line VI-VI of FIG. 5A when the container is deformed.

As shown in FIGS. 5A to 6B, when the plane member 3 is not provided with the opening 10, if the external pressure is applied to the liquid storage container, the central portion of the maximum side panel of the container is largely deformed as shown in FIG. 6B. When an outside rapid impact is applied due to dropping of the container, the force is transmitted to the plane member 3 so as to largely change the initial pressure of the liquid 7, leading to liquid leakage from the liquid supply port. Also, when the compression state of the spring member is changed due to changes in atmospheric pressure during shipping of the containers, the internal negative pressure in the liquid storage container is canceled, leading to liquid leakage.

According to the above-described embodiment, the protection member (the lid member 5) is positioned outside of the flexible member 4, and the opening is defined at the center position of gravity on the plane member 3 arranged in contact with the flexible member 4 so as to face the protection member. When the protection member is deformed, by the opening defined at the center position of gravity on the plane member 3, the contact between the protection member and the plane member 3 can be avoided.

Even when the liquid storage container is deformed by an external pressure during shipping or in operating time, the large changes in pressure are not generated, so that liquid can be appropriately ejected in a stable pressure state of the liquid without leakage of the liquid. Owing to the simple configuration in that the opening is defined at the center position of gravity on the plane member 3, such a liquid storage container can be provided simply as well as inexpensively.

A circular conic coil spring is used as the spring member 2, and the smaller diameter side of the spring is brought into contact with the plane member 3, so that when an external force is applied to the plane member, the plane member is liable to deform in a well-balanced manner, thereby securely suppressing changes in pressure of liquid.

Second Embodiment

Figure 7A:
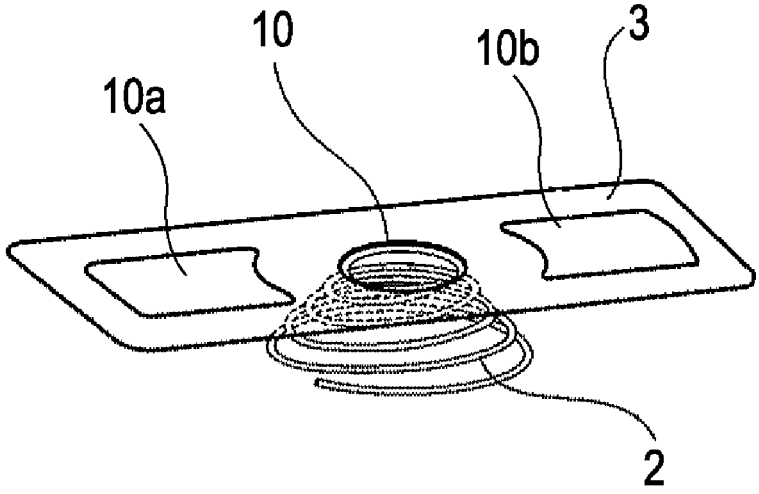
FIG. 7A is a perspective view of a spring member and a plane member according to a second embodiment.
Figure 7B:
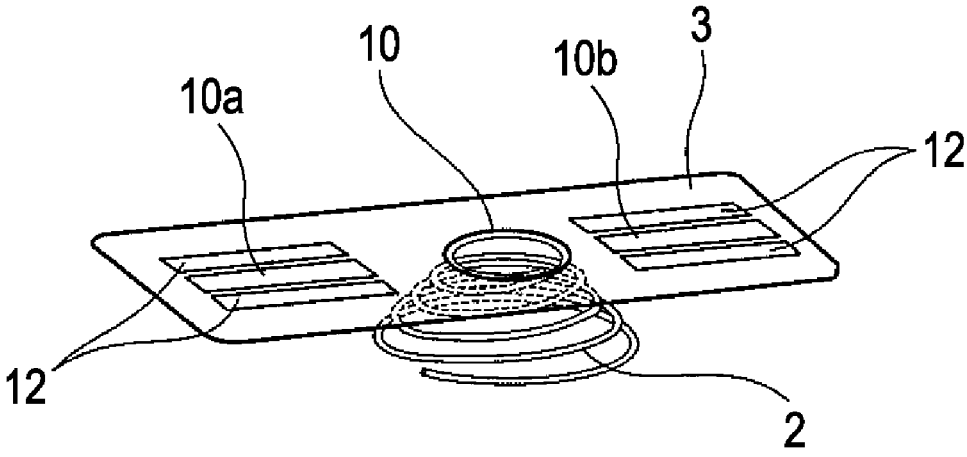
FIG. 7B shows a modification of the second embodiment.
Figure 8:
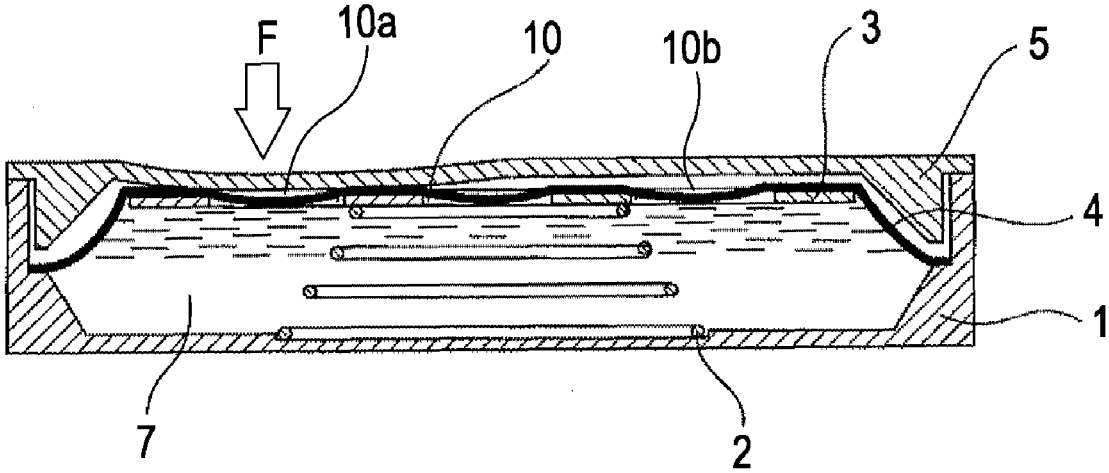
FIG. 8 is a sectional view of a liquid storage container according to the second embodiment.

FIGS. 7A to 8 are drawings for illustrating a second embodiment of the present invention.

According to the second embodiment, the plane member 3 is provided with a plurality of the openings 10. One of the openings 10 is located at the center of gravity of the plane member 3 in the same manner as in the first embodiment, and is positioned to face the central portion of the side panel, which is deformable to the utmost by the external pressure, of the liquid storage container. Moreover, at positions displaced from the central opening 10, other openings 10*a* and 10*b* are formed. Such other openings 10*a* and 10*b* are formed as a countermeasure for deformations other than that of the central side panel of the container.

The plane member 3 shown in FIG. 7A is provided with the central opening 10 and two openings 10*a* and 10*b* formed at positions in the left-right direction of the opening 10. By increasing the opening area of the opening 10 in such a manner, the effect of the deformation of the liquid storage container on the inside pressure change can be extremely reduced. On the other hand, if the openings are increased in such a manner, the rigidity of the plane member 3 is reduced, so that the holding power for holding the flexible member 4 flat may be impaired. For reinforcing the plane member 3, as shown in FIG. 7B, beam portions 12 may be formed in the vicinities of the openings 10*a* and 10*b*.

The openings 10*a* and 10*b* may be located at positions symmetrically with the opening 10 therebetween. In this case, the inside pressure change of the liquid storage container can be dispersed in a well-balanced manner.

Third Embodiment

Figure 9:
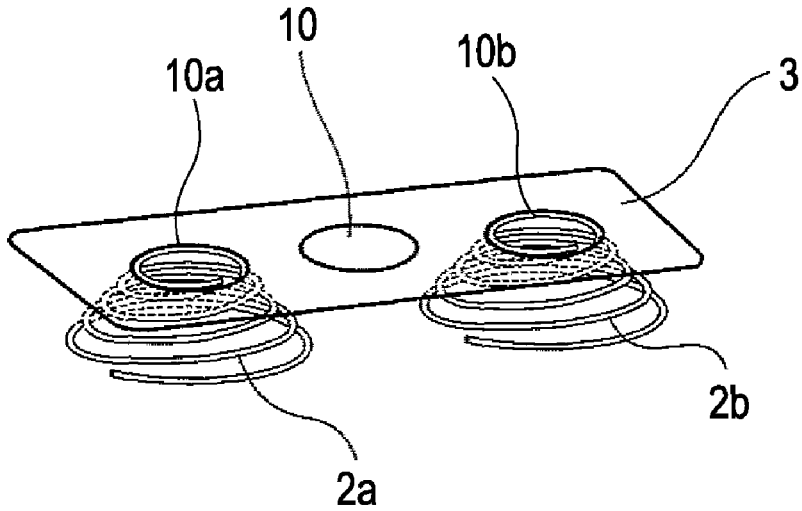
FIG. 9 is a perspective view of a spring member and a plane member according to a third embodiment.
Figure 10:
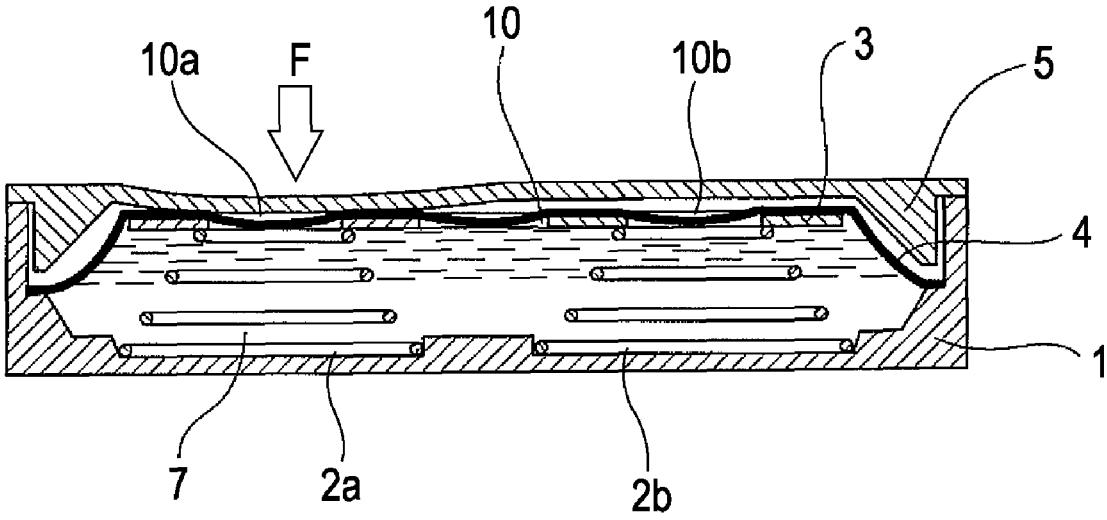
FIG. 10 is a sectional view of a liquid storage container according to the third embodiment.

FIGS. 9 and 10 are drawings for illustrating a third embodiment of the present invention. According to the third embodiment, a plurality of the spring members 2 is provided.

According to the embodiment, two coil springs 2*a* and 2*b* are provided in parallel. In the same way as the embodiments described above, the opening 10 is also formed at the center position of gravity of the plane member 3. Furthermore, the opening 10*a* is formed at a position facing the spring member 2*a* while the opening 10*b* is formed at a position facing the spring member 2*b*. As shown in FIG. 10, the openings 10*a* and 10*b* and the spring members 2*a* and 2*b* absorb and disperse an external force F correspondingly to deformations due to the external force F located at positions other than the central portion of the liquid storage container. The positions of the openings of the plane member 3 may also be set independently from the number of the spring members and the positions thereof.

Fourth Embodiment

Figure 11:
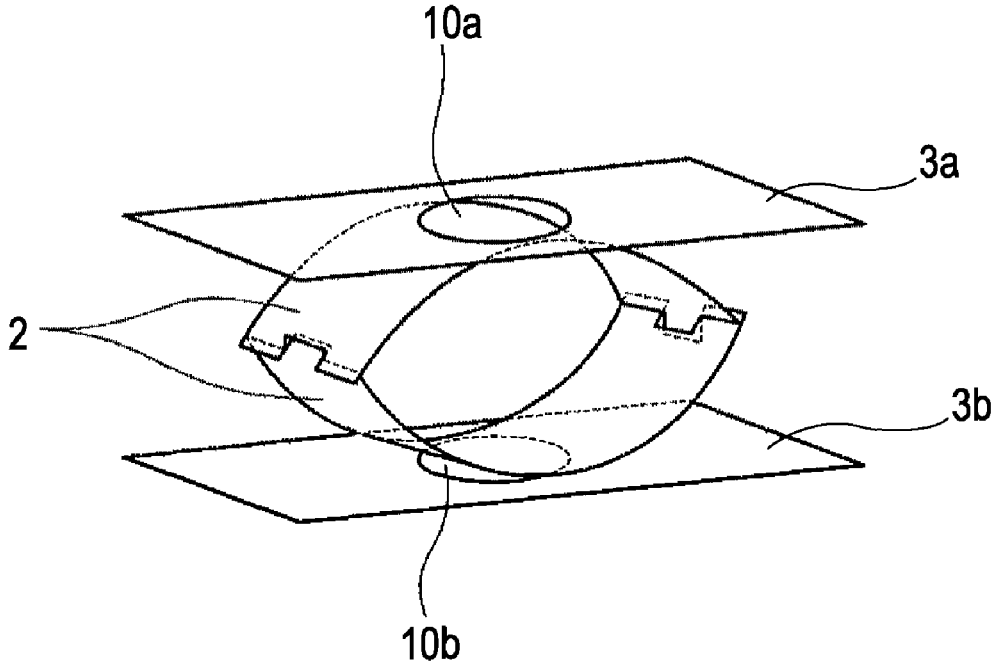
FIG. 11 is a perspective view of the spring member and the plane member according to the third embodiment.
Figure 12A:
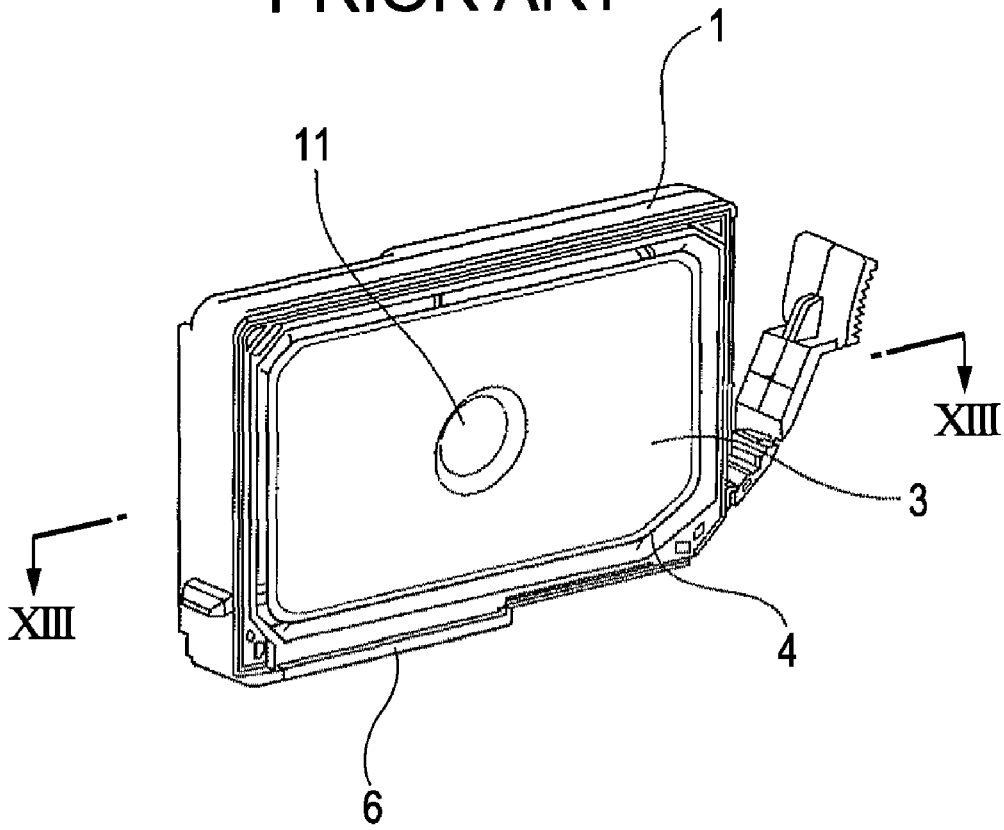
FIG. 12A PRIOR ART
FIG. 12A is a perspective view of a conventional liquid storage container in the state that a lid member is removed.
Figure 12B:
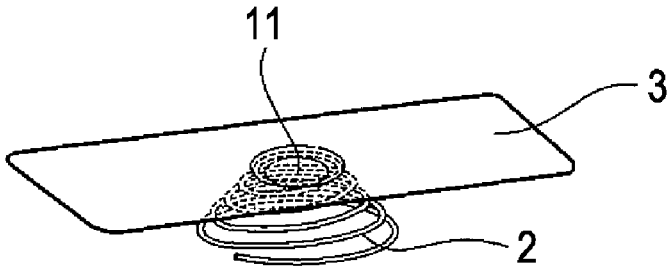
FIG. 12B PRIOR ART
FIG. 12B is a perspective view of the coupling state between a spring member and a plane member.

FIG. 11 is a drawing for illustrating a fourth embodiment of the present invention. According to the fourth embodiment, a leaf spring is used as the spring member 2.

According to the embodiment, two leaf springs combined with each other are used as the spring member 2. The leaf springs are arranged between two plane members 3*a* and 3*b* located within the storage space of the liquid 7. The central portion of the upper leaf spring in FIG. 11 is in contact with the opening 10*a* of the upper plane member 3*a*, and both ends are curved downwardly. On the other hand, the central portion of the lower leaf spring in FIG. 11 is in contact with the opening 10*b* of the lower plane member 3*b*, and both ends are curved upwardly. Both ends of these leaf springs are connected to each other so as to urge the plane members 3*a* and 3*b* in directions estranging the upper and lower plane members 3*a* and 3*b* from each other, i.e., in a direction expanding the storage space of the liquid 7. With decreasing amount of the liquid 7 within the liquid storage space, these leaf springs are flatten out in directions coming close to each other while maintaining the mutual connection state so as to serve as the spring member 2. As these leaf springs, the same shape of the springs 2 may be combined in a reverse manner to the embodiment so that the respective ends of the springs 2 touch the plane members 3*a* and 3*b*.

At this time, the contact positions between the springs 2 and the plane member are those other than the openings 10*a* and 10*b* located at the center positions of gravity of the plane member. However, as described above in the embodiment, by arranging the opening at a position other than the center position of gravity of the plane member, the elastic force of the spring member can be transmitted and absorbed to the plane member in a well-balanced manner.

When a position of the plane member 3 other than the central portion is pushed, the number of contacts between the plane member and the spring member is increased, so that the plane member 3 can be deformed by a comparatively small load. Thereby, the rapid change in pressure of the liquid in the liquid storage container can be prevented so as to maintain the internal negative pressure, so that in the same way as in the embodiments described above, the leakage of the liquid 7 can be prevented.

Other Embodiments

The plane member 3 for restricting the shape of the flexible member 4 may be any shape as long as it touches the flexible member 4, so that it may be in contact with the external surface of the flexible member 4 or it may be bonded on the external surface of the flexible member 4. The plane member 3 for restricting the shape of the flexible member 4 may be provided with the opening 10 for buffering the pressure and impact from the protection member 5.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-380064 filed Dec. 28, 2005, which is hereby incorporated by reference herein in its entirety.

What is claimed is:

1. A liquid storage container comprising:

a flexible sheet and a wall forming a liquid storage space;

a supply port supplying liquid in the liquid storage space to the outside;

a protection member having substantially the maximum superficies of outer frames, placed outside of the flexible sheet;

a plane member having an opening, the plane member being located inside the liquid storage space so as to be opposing to the protection member with the flexible sheet therebetween; and a conic coil spring generating force for pushing the flexible sheet to the protection member, with the plane member therebetween, so as to generate negative pressure to a liquid in the liquid storage space, wherein the opening is defined in the plane member so as to include a position facing a position that is deformable to the utmost of the protection member by an external pressure, wherein a smaller diameter side of the conic coil spring is coupled to the inside of the opening, and a diameter of the smaller diameter side in the coupled state is substantially the same as a diameter of the opening, and wherein a bigger diameter side of the conic coil spring is in contact with the wall, and the flexible sheet is in contact with the plane member so as to cover the opening on the plane member.

2. The container according to claim 1, wherein the liquid storage space is adapted to accommodate ink.

3. The container according to claim 1, wherein, by using liquid inside the liquid storage space, the plane member and the flexible sheet move in a direction of the wall, and a capacity of the liquid storage space decreases.

4. The container according to claim 1, wherein a position at which the opening is provided includes a position of gravity center of the plane member.

5. The container according to claim 1, wherein the bigger diameter side of the conic coil spring is in contact with a recess provided on the wall.

* * * * *